United States Patent [19]

Emmer

[11] Patent Number: 4,809,475

[45] Date of Patent: Mar. 7, 1989

[54] FACADE SYSTEM OF METAL SECTIONS

[75] Inventor: Hans Emmer, Liestal, Switzerland

[73] Assignee: Eltreva AG, Aesch, Switzerland

[21] Appl. No.: 929,850

[22] Filed: Nov. 13, 1986

[30] Foreign Application Priority Data

Nov. 14, 1985 [DE] Fed. Rep. of Germany ..... 3540385

[51] Int. Cl.[4] ..... E04B 2/88

[52] U.S. Cl. ..... 52/235; 52/208; 52/403

[58] Field of Search ..... 52/235, 396, 403, 208

[56] References Cited

U.S. PATENT DOCUMENTS

| | | | |
|---|---|---|---|
| 2,985,263 | 5/1961 | Maciunas . | |
| 4,543,755 | 10/1985 | Crandell | 52/235 |
| 4,543,756 | 10/1985 | Kaminaga | 52/235 |
| 4,614,067 | 9/1986 | Martsubara | 52/235 |
| 4,619,092 | 10/1986 | Kamminaga | 52/235 |
| 4,662,145 | 5/1987 | Tanikawa | 52/235 |

FOREIGN PATENT DOCUMENTS

| | | | |
|---|---|---|---|
| 0153547 | 9/1985 | European Pat. Off. . | |
| 832132 | 12/1957 | United Kingdom | 52/235 |
| 2127878 | 4/1984 | United Kingdom . | |
| 2164974A | 4/1986 | United Kingdom | 52/235 |

*Primary Examiner*—Henry E. Raduazo

*Attorney, Agent, or Firm*—Foley & Lardner, Schwartz, Jeffery, Schwaab, Mack, Blumenthal & Evans

[57] ABSTRACT

A facade system of metal sections which receive plate-shaped elements between them such as fixed glazing, sashes, panels or the like which are each provided with an encircling auxiliary frame located exclusively on the room side and connected by releasable connecting means to main frames having means for attachment to a structure, in which:

(a) the facade system consists of several separately formed and individually manipulable main frames into each of which at least one auxiliary frame is inserted;

(b) on the room side, the main and auxiliary frames form a flat reveal extending perpendicularly to the facade plane;

(c) inside this flat reveal, the main and auxiliary frames are spaced a clearance distance from one another which is closed air-tight by an encircling first seal, which simultaneously covers the releasable connecting means between the main and auxiliary frames;

(d) the main frames are air-tightly connected on the room side to the respectively adjacent main frames by a second seal; and (e) the weather seams between all plate-shaped elements are each closed air-tight by a third seal.

26 Claims, 8 Drawing Sheets

FACADE SYSTEM OF METAL SECTIONS

BACKGROUND OF THE INVENTION

The invention relates to a facade system of metal sections which accommodate between them plate-shaped elements such as fixed glazing, sashes, panels or the like which are provided in each case with an encircling auxiliary frame which is located exclusively on the room side and which is connected by releasable connecting means to main frames having means for attachment to a building.

A device of this type is disclosed in published European Patent Application Nd. EP-Al No. 0 153 574. Here, the auxiliary frame consists of U-sections which, with one of their U-legs, are bonded on the room side via a silicone bond, in conjunction with a further adhesive strip, to insulating glazing, the U-web being in alignment with the edge area of the insulating glazing. The main frame, in both the horizontal and the vertical areas, is formed in each case by a section which is common to two adjacent plate-shaped elements and which in the horizontal area, with a supporting leg, forms the rabbet for accommodating the glazing and also the supporting surface for the blocking piece. The intermediate space between the edge areas of adjacent insulating glazing parts is filled with a polyurethane sealing contact mass which is covered on the weather side by a silicone joint seal. In both the horizontal and vertical areas, the main frame, with one frame leg in each case, overlaps the associated auxiliary frame section, the encircling seal which is provided in this engagement area forming a sealing plane lying parallel to the facade plane. In this arrangement, the main frame, with said frame leg, in each case simultaneously engages the auxiliary frame sections of two adjacent insulating glazing parts. Each of the U-shaped auxiliary frame sections is engaged by one end of a coupling section which is supported with its other end in grooves of the main frame and is braced relative to the latter by pressure screws. By tightening the pressure screws, the coupling between auxiliary and main frames is secured, and at the same time the seal provided between the two frame parts is compressed. The auxiliary frame is completely covered on the room side by the main frame and is completely covered in the inner area of each plate-shaped element by the coupling sections. The function of the auxiliary frame is merely to accommodate the coupling sections. In order to cover the area of the coupling screws and also the engagement area of the coupling sections in the main frames, cover sections are provided which can be clipped in separately and which cover the frame system toward the inside and are aligned with the coupling sections.

This previously known facade system is an upright/-crosspiece system in which the auxiliary frames on the building are inserted into the respective bays of this facade. If glass is replaced later, the upright and cross-piece casing must first be dismantled, which can involve difficulties since movable walls, for example, are mounted on upright joints on the room side.

SUMMARY OF THE INVENTION

The object of the present invention is to further develop the facade system described above in such a way that it permits a large number of design possibilities and enables assembly to be carried out largely at the manufacturer's works.

This object is achieved according to the invention by the following features:

(a) the facade system consists of several main frames, each separately formed and individually manipulable, into each of which at least one auxiliary frame is inserted;

(b) on the room side, the main and auxiliary frames form a flat reveal lying perpendicularly to the facade plane;

(c) inside this flat reveal, the main and auxiliary frames are at a clearance distance from one another which is closed air-tight by a first encircling seal which simultaneously covers the releasable connecting means between the main and auxiliary frames;

(d) on the room side, the main frames are connected air-tight to the respectively adjacent main frames by a second seal;

(e) between all plate-shaped elements, the weather seams are each closed air-tight by a third seal.

Thus, in general, the invention comprises a facade system of metal sections which receive plate-shaped elements between them which are each provided with an encircling auxiliary frame located on the room side of the facade and connected by releasable connecting means to main frames having means for attachment to a structure, wherein:

(a) the facade system comprises a plurality of separately formed and individually manipulable main frames in each of which at least one auxiliary frame is inserted;

(b) the main and auxiliary frames form a flat reveal extending on the room side of the facade perpendicular to the facade plane;

(c) inside said reveal the main and auxiliary frames have a clearance spacing between them which is air-tightly closed by a first encircling seal which simultaneously covers said releasable connecting means between the main and auxiliary frames;

(d) the main frames are each air-tightly connected by a second seal on the room side to an adjacent main frame; and (e) weather seams between adjacent plate-shaped elements are each air-tightly closed by a third seal.

In this arrangement, it is advantageous if a frame leg of the main frame overlaps with a bearing surface of the auxiliary frame, which bearing surface extends perpendicularly to the facade plane, and if a blocking piece is provided between this bearing surface and the frame leg of the main frame in order to position the auxiliary frame in the main frame.

According to the invention it is possible that a main frame is subdivided by at least one horizontal cross member which, with a lower and an upper auxiliary frame, forms a lower and upper flat reveal on the room side.

A main frame can therefore accommodate a single plate-shaped element with its auxiliary frame, but also several plate-shaped elements with their auxiliary frames when one or more cross members are arranged therein.

The system according to the invention enables the individual elements of the facade to be assembled at the manufacturer's premises, the main and auxiliary frames likewise being connected to one another at the manufacturer's. The separate design of the main and auxiliary frames on the one hand facilitates the manufacture of the individual facade elements and on the other hand enables an element to be replaced in a previously completed facade system, for example as a result of glass breakage.

The auxiliary frame can be fitted with various segments. In this case, it can take on other functions, for example as a bearer for additionally suspended auxiliary sections, or auxiliary sections attached in some other way. The auxiliary frame can have a bonding leg which extends parallel to the facade plane and, together with a seal and the lateral edge of a plate-shaped element, forms a groove which is open toward the adjacent auxiliary frame and is filled with a silicone adhesive which firmly bonds the plate-shaped element to the bonding leg of the auxiliary frame. The individual plate-shaped element therefore requires no auxiliary frame on the weather side, so that the facade system as a whole does not reveal any sections on the weather side. A glass-only facade is therefore possible. However, since a construction of this type is not yet permitted everywhere, it can be arranged that adjacent frame legs of adjacent or superposed main or auxiliary frames form between them an undercut groove for accommodating a tensioning bolt which protrudes outward on the weather side between two plate-shaped elements and serves to attach cover strips or the like which overlap these elements on the weather side.

So that auxiliary and main frames can be simply and reliably connected to one another, but also so that they can be released again from one another, it is advantageous if the releasable connecting means consists of a U-shaped clamp which can be moved within the facade plane, and if in the coupling position the U-legs of the clamp, extending parallel to the facade plane, overlappingly engage a retaining leg on each of the auxiliary and main frames. So that even high forces can be reliably transmitted, it is at the same time advantageous if at least one retaining leg has an undercut, behind which, in the coupling position, a lug disposed on a U-leg of the clamp engages. In this respect, the U-web of the clamp may have a continuous internal thread which extends parallel to the U-legs and into which a freely rotatable coupling screw mounted in a frame leg is screwed.

So that assembly and disassembly can be carried out from different sides, it is advantageous if the coupling screw has a recess in each of its two ends for a rotary turning tool, preferably a hexagonal socket.

Accessibility of the coupling screws is facilitated when one end of each screw is aligned with the clearance space between the auxiliary and main frames. In this way, an additional advantage is simultaneously achieved that the seal covers the screws and protects them from soiling, and at the same time ensures a visually attractive overall appearance.

BRIEF DESCRIPTION OF THE DRAWINGS

Further features and advantages of the invention will be described hereinafter in greater detail with reference to illustrative embodiments shown in the accompanying drawings, which are not to be taken as limiting, in which.

DETAILED DESCRIPTION OF PREFERRED EMBODIMENTS

Figure 1:
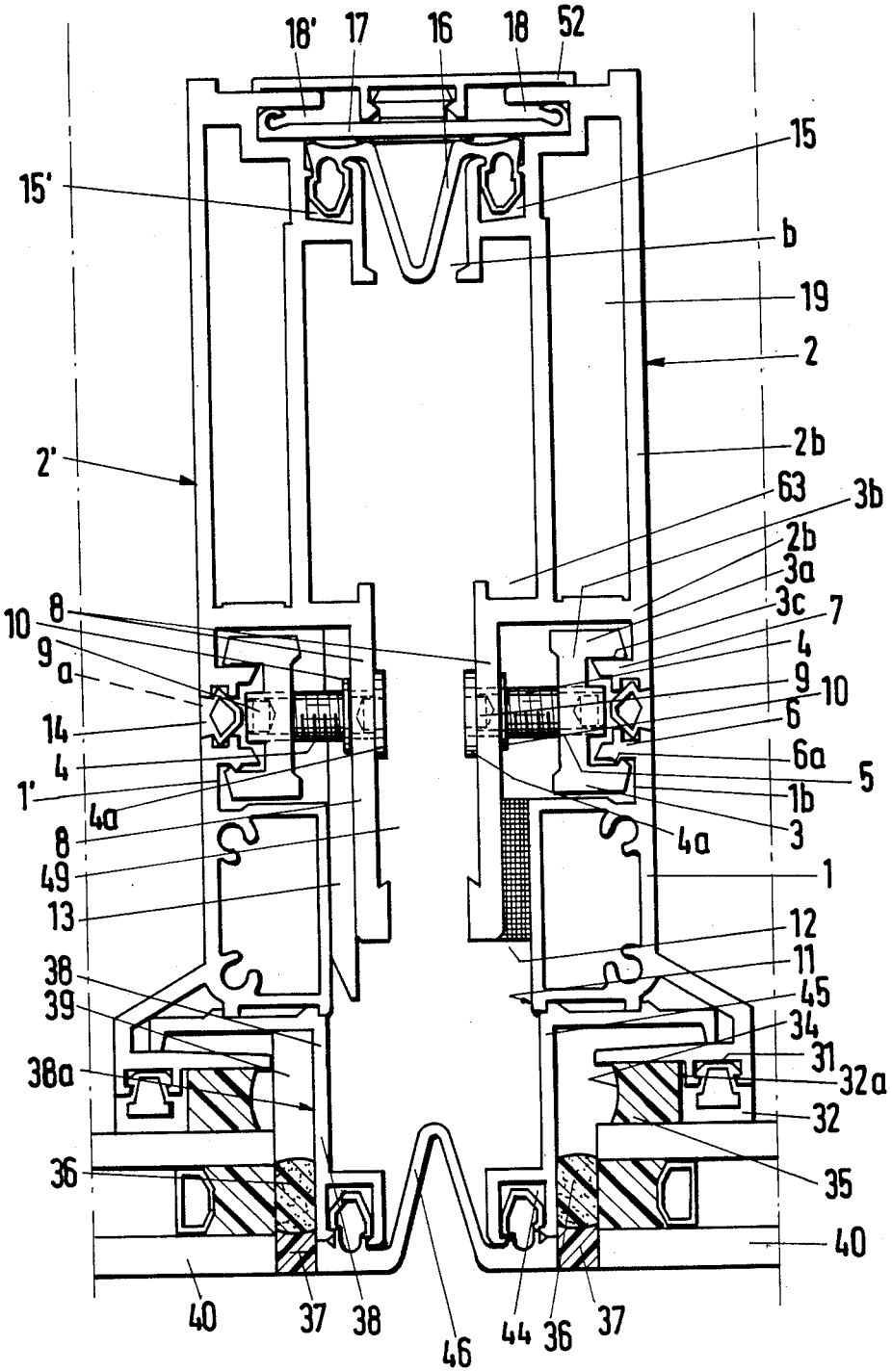
FIG. 1 shows a vertical section through a facade-element joint.

FIG. 1 shows a vertical section through a joint between two facade elements which are arranged one above the other and are in each case fitted with insulating glazing. Each facade element consists of a main frame 2 into which an encircling auxiliary frame 1 is inserted which is fitted with a plate-shaped element in the form of fixed glazing 40 and is connected to the associated main frame 2 by a releasable coupling.

The detachable coupling comprises a U-shaped clamp 3 which can be displaced inside the facade plane and the U-leg 3*a* of which, lying parallel to the facade plane, in the coupling position, engages each of the auxiliary and main frames 2 and 1 through a retaining leg 6, 7. The U-web 3*b* of the clamp 3 has a continuous internal thread 5 which extends parallel to the U-legs 3*a* and into which a coupling screw 4 is screwed which is mounted in a frame leg 8 so as to be freely rotatable therein, and which with its other end, is in alignment with a clearance space a between the auxiliary and main frames 1 and 2. The coupling screw 4 has a hexagonal socket 9 in each of its two ends for a rotary turning tool, is supported by a head 4*a* on the side of the frame leg 8 remote from the clamp 3, and is secured on the opposite side of the frame-leg by a Seeger ring 10.

The frame leg 8 is disposed on the main frame 2 and overlaps with a bearing surface 11 of the auxiliary frame 1, whereby in this overlap area in the upper horizontal region, a seal 12, but otherwise a blocking piece 13, is provided. At least one retaining leg 6 of the auxiliary frame 1 has an undercut 6*a*, behind which, in the coupling position, a lug 3*c* disposed on a U-leg 3*a* of the clamp 3 engages.

On the room side, the main and auxiliary frames form a flat reveal 1*b* and 2*b* extending perpendicular to the facade plane, inside which reveal 1*b* and 2*b* the two frames are at the above-mentioned clearance distance a from one another which is closed air-tight by a first encircling seal 14 which at the same time covers the coupling screws 4. As a result of the seal 14, each auxiliary frame 1 and 1', respectively, is inserted largely air-tight into the associated main frame 2 and 2', respectively. As a result of the seal 12 additionally provided in the upper horizontal area, it is simultaneously ensured that moisture possibly penetrating on the weather side cannot penetrate into the engagement area between the auxiliary and main frames and therefore into the coupling area. Rainwater therefore remains in front of the seal 12 on the auxiliary section or runs downward in this area between the plate-shaped elements in the facade and can be drained off at this location.

The clearance space b between each two main frames 2, 2' arranged laterally or vertically adjacent one another is closed air-tight on the room side by a second seal 16, which according to the illustrative embodiment is an encircling collapsible seal pressed into a groove 15, 15' in each of the two main frames. In addition, a strip-shaped cover 17 is provided on the room side between the two main frames 2, 2', which cover 17 is pushed into opposing grooves 18, 18' of the two main frames and can be covered by a clipped-on cover strip 52.

Figure 4:
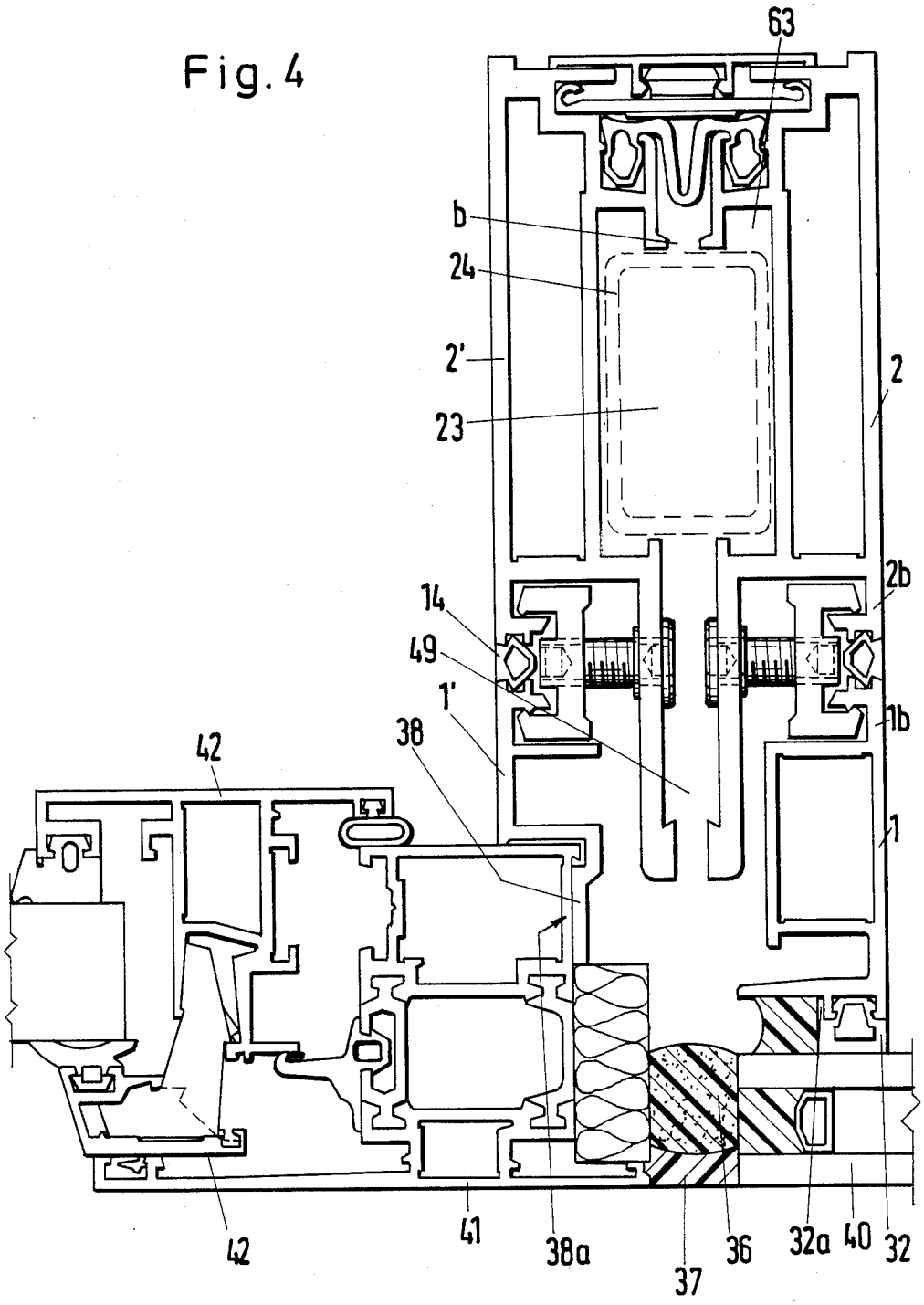
FIG. 4 shows a horizontal section through a facade-element joint.

The main frame 2 comprises a box section 19 into which a stiffening piece, a vertical connection to the overlying or underlying main frame 2', or a corner angle is pushed. Each two main frames 2, 2' arranged next to one another enclose a cavity 23 which is approximately rectangular or square in cross section and into which is pushed a steel tube 24 which is fitted to this cross section (FIG. 4).

Figure 2:
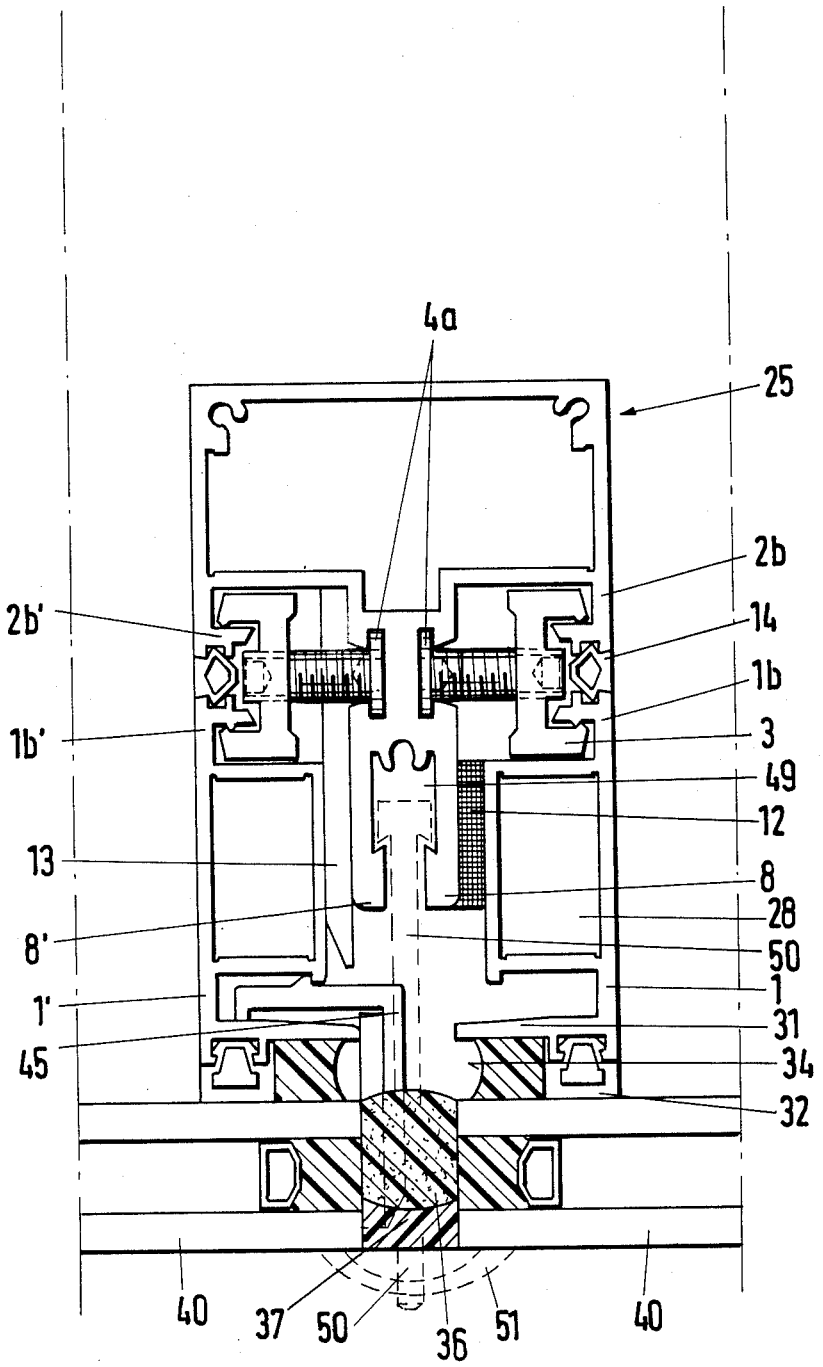
FIG. 2 shows a vertical section through a cross member.

FIG. 2 shows a vertical section through a horizontal cross member 25 which subdivides a main frame. The lower and upper auxiliary frames 1, 1' respectively are each fitted with fixed glazing 40. The auxiliary frame 1 or 1' respectively comprises a box section 28 into which a corner angle (not shown) can be pushed. The heads 4a of the coupling screws 4 are guided in an undercut groove in the frame leg 8 so that the Seeger ring 10 for securing the coupling screw 4 can be omitted. So that the hexagonal socket 9 provided on the screw head side can be used, slotted holes (not shown) can be provided in the frame leg 8 between the screw heads 4a which are vertically offset opposite one another, the slot width of which slotted holes is smaller than the diameter of the screw head.

According to FIGS. 1 and 2, the auxiliary frame 1 has a bonding leg 31 which extends parallel to the facade plane and, together with a seal 32 and the lateral edge of the fixed glazing 40, forms a groove 34 which is open toward the adjacent auxiliary frame 1' and is filled with a silicone adhesive 35 which firmly bonds the fixed glazing 40 to the bonding leg 31.

In the embodiment according to FIG. 1, the clearance space between the two auxiliary frames 1, 1' arranged one above the other is closed on the weather side by an encircling collapsible seal 46 pressed into a groove 44 of each clipped-in auxiliary section 45. This auxiliary section 45 has a supporting leg 38, the supporting surface 38a of which, extending perpendicularly to the facade plane, accommodates a blocking piece 39 and also a sealing contact mass 36 with a silicone joint seal 37 for the fixed glazing 40.

In the embodiment according to FIG. 2, an auxiliary section 45 is merely clipped into the auxiliary frame 1' shown in the left-hand half of the drawing. In this embodiment, the intermediate space between the adjacent glazing parts 40 is filled in each case with a sealing contact mass 36, which is covered on the weather side by a silicone joint seal 37.

Figure 3:
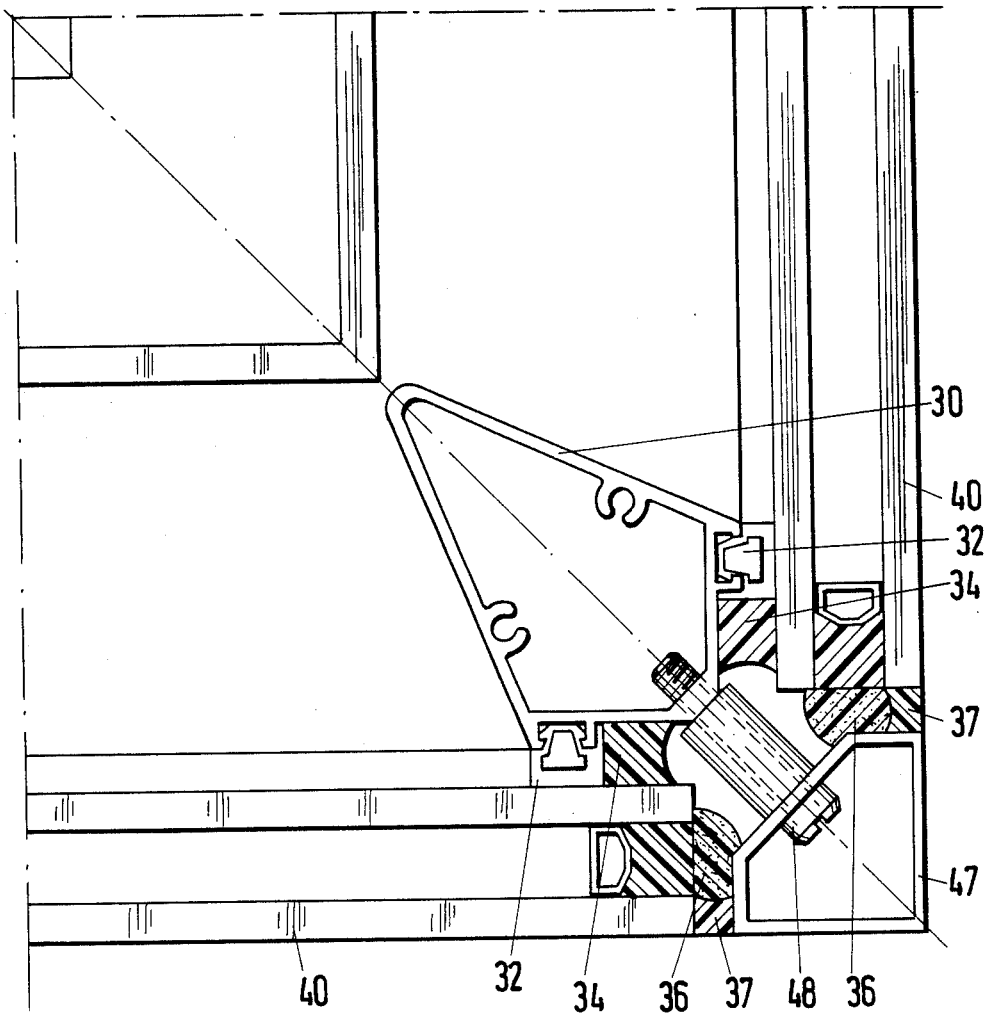
FIG. 3 shows a horizontal section through a 90° facade corner.

FIG. 3 shows a schematic representation of a horizontal section through a 90° facade corner, the two facade elements each being fitted with a fixed glazing 40. An upright 30 formed as a hollow section is built into the auxiliary frame running around the facade corner area. The actual corner area is formed by a correspondingly formed cover section 47 which can be connected to the upright 30 via screws 48. The gaps between the cover profile 47 and fixed glazing 40 are in turn filled with a sealing contact mass 36 and a silicone joint seal 37 on the weather side.

In FIG. 4, the left-hand half of the drawing shows that the supporting leg 38 can also be formed integrally with the auxiliary frame 1 or 1'. Here, the supporting leg 38 accommodates a window frame 41 for a sash 42.

Figure 8:
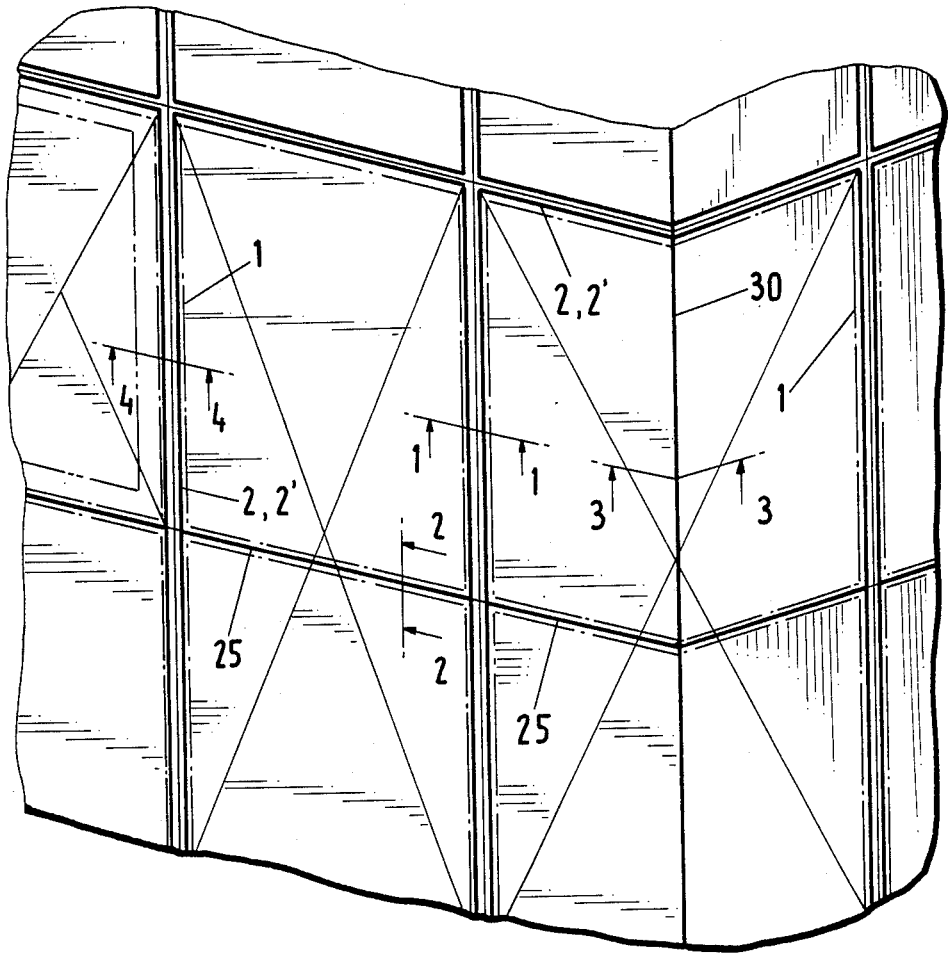
FIG. 8 is a perspective view showing the side of a building with the various components from FIGS. 1 through 4 in their assembled relationships.

FIG. 8 shows the main frame 2, 2' subdivided by at least one horizontal cross member 25.

Figure 5:
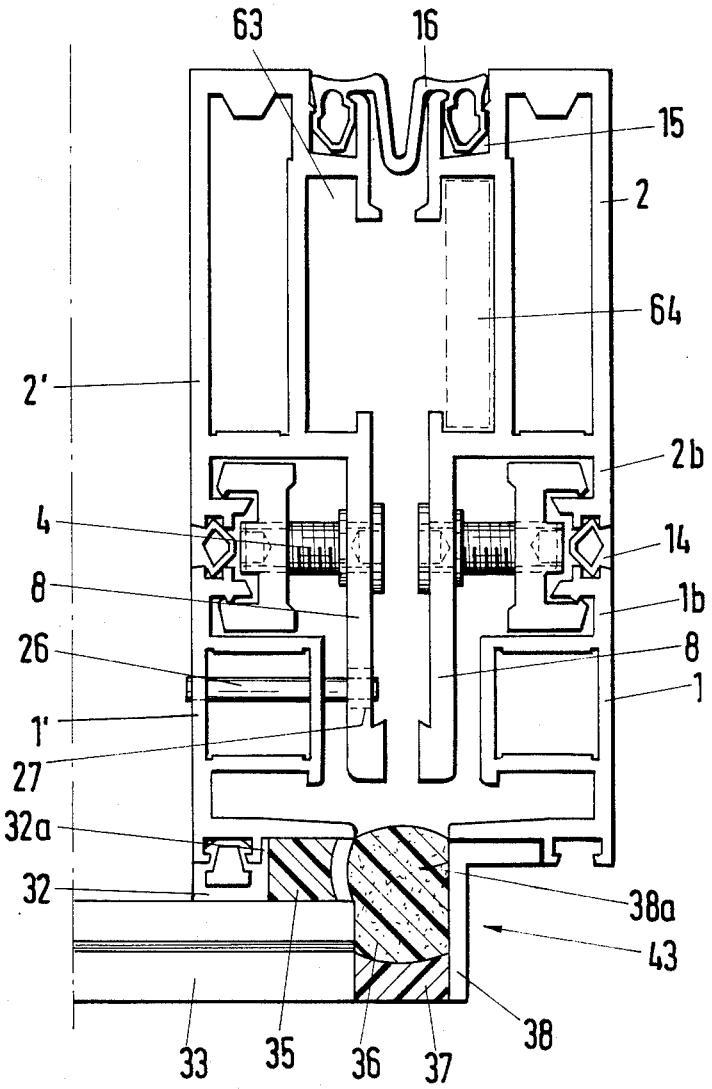
FIG. 5 snows, a horizontal section according to FIG. 4 through a modified embodiment.

In the embodiment according to FIG. 5, a plate element 33, for example a laminated safety glass, is bonded to the auxiliary frame 1' by a silicone bond 35. The intermediate space toward the supporting leg 38 is again filled with a sealing contact mass 36 together with a silicone joint seal 37 on the weather side. Otherwise, in this construction, the supporting leg 38 forms a connection to an empty space which can be filled on the building side with a separate element 43 (not shown in greater detail). The vertical section of the auxiliary frame 1' is suspended, by means of a pin 26 lying horizontally within the facade plane, in an undercut groove 27 in the main frame 2'.

In all embodiments, it is possible in principle, in addition to the silicone bond 35, and if necessary also instead of this silicone bond, to provide cover strips 51 which, on the weather side, overlap the edge area of the plate-shaped elements 33; 40; 41, 42; 43 and, on the room side, are fastened onto or between adjacent main frames. An exemplary arrangement for this purpose is shown in broken lines in FIG. 2. The two adjacent frame legs 8 form between them an undercut groove 49 for receiving a tensioning bolt 50 which protrudes outwardly on the weather side between two facade elements and serves to attach cover strips 51 or the like which overlap the plate-shaped elements on the weather side.

Figure 6:
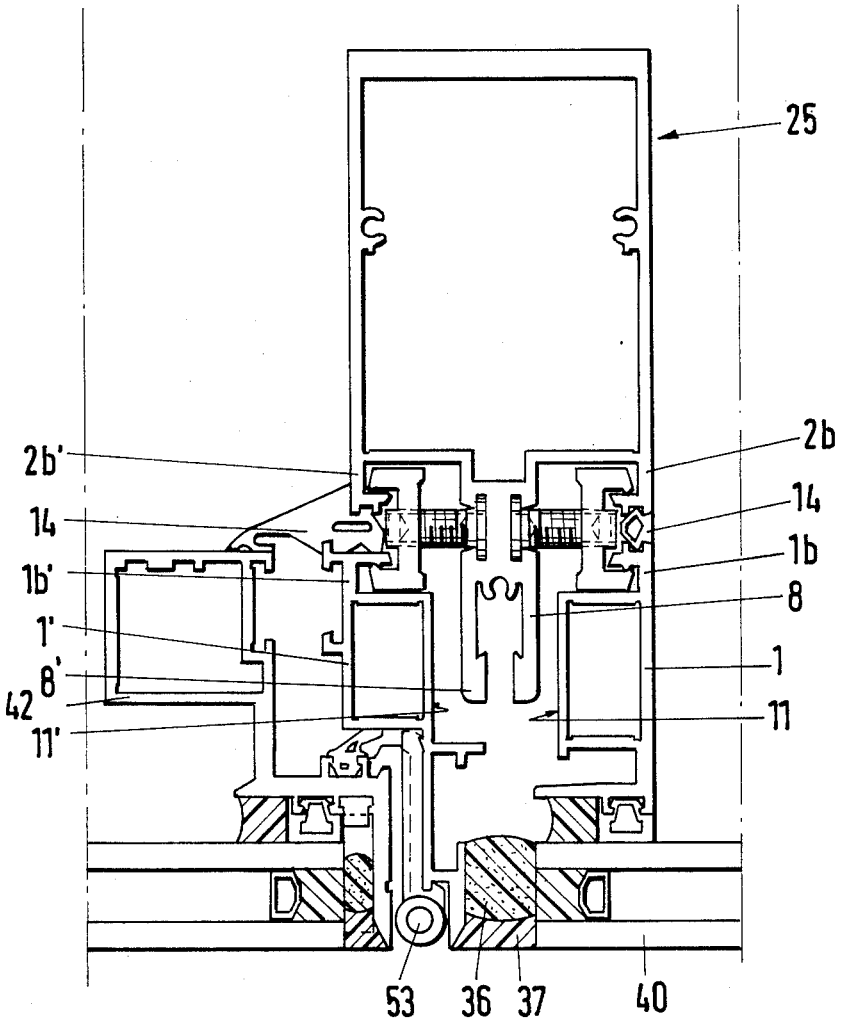
FIG. 6 shows a vertical section according to FIG. 2 through a modified embodiment.

FIG. 4 shows a facade system with a conventional window frame 41 for a sash 42. The metal sections located on the weather side in this construction are disadvantageous because the fixed glazing 40 provided next to the sash in the illustrated embodiment has no metal sections at all which overlap the glazing on the weather side. FIG. 6 shows a vertical section through a horizontal cross member 25 with lower fixed glazing 40 and an upper sash 42. A second auxiliary frame 53, which receives the sash 42, is attached in the vicinity of the sealing contact mass 36 and the silicone joint seal 37 which close the head joint between two adjacent plate-shaped elements. In this case the seal 14 between main and auxiliary frames serves at the same time as a stop seal for the sash 42. Here, therefore, all metal sections are omitted in the visible area of the facade. In the area of the "window frame", although a silicone joint seal is obtained which is twice as wide, it is hardly noticeable in the overall appearance of an "all glass" facade.

In all embodiments according to the invention, the auxiliary frame lies in the visible area and is designed so that it is suitable for accommodating various elements. Its depth is adequate for accommodating, for example, spandrel or facing elements or the like; the coupling also remains accessible in the case of correspondingly deep insulation or correspondingly deep spandrel or facing elements.

Figure 7:
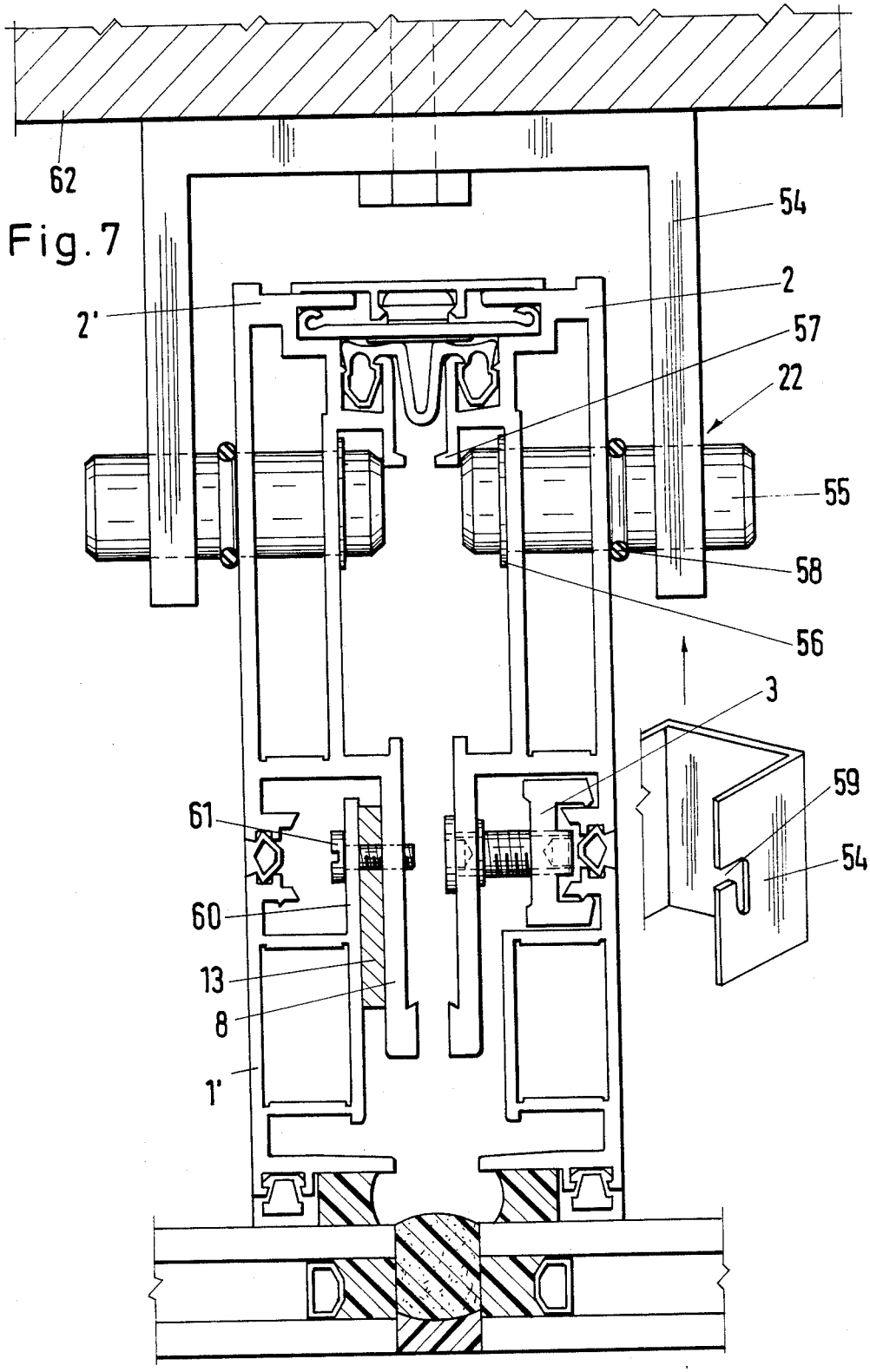
FIG. 7 shows a horizontal section through the edge area of two main frames arranged next to one another and connected to a structure.

FIG. 7 shows a horizontal section through the adjacent edge area of two main frames 2, 2' which are attached to a structure 62 by auxiliary means 22. These means 22 each comprise a horizontal pin 55, one end of which is pushed through a bore provided in the main frame 2 or 2' until it abuts against a projecting portion 57 of this main frame. The pin 55 is secured in this position by a Seeger ring 56. The bore is closed air-tight by means of an O-ring 58. Pin 55 is suspended with its other end in an L-shaped stamped-out portion 59 of a retaining part 54 previously attached to structure 62. The retaining part 54 is formed as a U-section, in the U-legs of which the stamped-out portions 59 are arranged, as can be seen from the reduced scale partial perspective illustration.

In the main frame 2' shown on the left-hand side in FIG. 7, the connection to the associated auxiliary frame 1' is effected via screws 61 instead of the clamp 3, which screws 61 connect a web 60 of the auxiliary frame 1' to the frame leg 8 of the associated main frame 2'.

The second seal 16 between the main frames as well as the third seal 36, 37 or 46 serve to absorb building tolerances, building vibrations or the like; the collapsible seal 46 being provided as a rule only in the case of a horizontal joint between vertically adjacent main frames, where larger tolerances are to be absorbed. In a vertical joint between two laterally adjacent main frames, only material (thermal) expansion differences occur as a rule, and these can be readily absorbed by a silicone joint seal 37. Since the cross member 25 subdividing the main frame need not absorb any building movements, an elastic connection is not required between the plate-shaped elements or auxiliary frames inserted into a main frame, so that the cross member 25 on the room side can be made box-shaped and in one piece.

In the construction according to the invention, each individual plate-shaped element can be replaced individually after the weather seam is cut open. All main frames are air-tightly connected by the second seal 16 to one another on the room side, while all auxiliary frames are air-tightly installed by the first seal 14 in each case in the associated main frame. The second seal 16 and also the strip-shaped guides 17 or the cover strips 52 move with any building movements.

It can be seen from FIG. 5 in particular that the main frame 2, 2' has an undercut groove 63 into which, when the main frames are arranged one above the other, a flat steel bar 64 is pushed which bridges the horizontal joint and which is shown in broken lines in FIG. 5. This vertical guide in the area of the horizontal joint is of particular advantage when the thusly interconnected main frames form the end piece of a facade.

In the various embodiments, the fixed glazing 40 is shown bonded to the bonding leg 31 (see, e.g., FIG. 1). The seal 32 provided here fulfills several functions: besides its function as a bearing seal, it serves to form a clean joint between, for example, the fixed glazing 40 and the bonding leg 31; in addition, however, it is used to limit the silicone bond 35 which fills the groove 34. The seal 32 forming the base of the groove, on its side facing toward the bond, is firmly secured to this bond which in turn is firmly bonded to the plate-shaped element on the one side and to the bonding leg 31 on the other side. Suction acting on the plate-shaped element leads to deformation of this element and thus also to deformation of the bond in such a way that the latter contracts in the area facing toward the seal 32, therefore moving away from this seal. But since there is a fixed bond in this area with the seal, the latter has to be made so that it can follow this deformation without the adhesive connection between the bond and the seal tearing. For example, the sealing section **32*a* bonded to the silicone adhesive 35 can be formed as a hollow body which allows a corresponding deformation. However, the section 32*a* can also be connected to the remaining body of the seal 32** by a center web of relatively thin dimensions.

The foregoing description has been set forth merely to illustrate the invention and is not intended to be limiting. Since modifications of the described embodiments incorporating the spirit and substance of the invention may occur to persons skilled in the are, the scope of the invention should be limited solely with respect to the appended claims and equivalents.

What is claimed is:

1. A facade system of metal sections which receive plate-shaped elements between them which are each provided with an encircling auxiliary frame located on the room side of the facade and connected by releasable connecting means to main frames having means for attachment to a structure, wherein:

(a) the facade system comprises a plurality of separately formed and individually manipulable main frames in each of which at least one auxiliary frame is inserted;

(b) the main and auxiliary frames form a flat reveal extending on the room side of the facade perpendicular to the facade plane;

(c) inside said reveal the main and auxiliary frames have a clearance space between them which is air-tightly closed by an encircling first seal which simultaneously covers said releasable connecting means between the main and auxiliary frames;

(d) the main frames are each air-tightly connected by a second seal on the room side to an adjacent main frame; and (e) weather seams between adjacent plate-shaped elements are each air-tightly closed by a third seal.

2. A facade system according to claim 1, wherein a frame leg on the main frame overlaps with a bearing surface on the auxiliary frame extending perpendicularly to the facade plane, and wherein a blocking piece is provided between said bearing surface and said frame leg in order to position the auxiliary frame in the main frame.

3. A facade system according to claim 2, wherein a fourth seal is arranged in an upper horizontal area between said bearing surface on the auxiliary frame and said frame leg on the main frame.

4. A facade system according to claim 1, wherein said second seal is a collapsible seal pressed into a groove in each of two adjacent main frames.

5. A facade system according to claim 1, wherein said third seal comprises a sealing contact mass which is covered on the weather side by a silicone joint seal.

6. A facade system according to claim 1, wherein said third seal between the plate-shaped elements of vertically adjacent main frames is a collapsible seal.

7. A facade system according to claim 1, wherein each plate-shaped element is bonded to its auxiliary frame.

8. A facade system according to claim 7, wherein the auxiliary frame has a bonding leg which extends parallel to the facade plane and which, together with a seal and the lateral edge of a plate-shaped element, forms a groove which is open toward an adjacent auxiliary frame and is filled with a silicone adhesive which firmly bonds the plate-shaped element to the auxiliary frame bonding leg.

9. A facade system according to claim 1, wherein the auxiliary frame has a supporting leg projecting into the edge area of the associated plate-shaped element and having a supporting surface oriented perpendicularly to the facade plane, said supporting surface accommodating a blocking piece for a fixed glazing, a window frame for a sash, or a sealing contact mass with a silicone joint seal for a separate built-in element.

10. A facade system according to claim 2, wherein a main frame is subdivided by at least one horizontal cross member which, with a lower and an upper auxiliary frame, forms a lower and upper flat reveal on the room side.

11. A facade system according to claim 10, wherein the cross member has a first frame leg which overlaps with the bearing surface of the lower auxiliary frame and a second frame leg which overlaps with the bearing surface of the upper auxiliary frame of the same main frame.

12. A facade system according to claim 1, wherein a hollow upright is built into the auxiliary frame extending around a facade corner area.

13. A facade system according to claim 1, wherein said means for attaching each main frame to a structure comprise a horizontal pin having one end pushed through a bore provided in the main frame until it abuts against a projecting portion of this main frame, and having its other end suspended in a punched-out portion of a retaining part previously attached to said structure.

14. A facade system according to claim 13, wherein said bore through which said pin is pushed is sealed air-tightly by an O-ring disposed on said pin.

15. A facade system according to claim 1, wherein a strip-shaped cover is provided on the room side between two main frames and received in mutually opposed grooves of said two main frames.

16. A facade system according to claim 1, wherein each two adjacently arranged main frames enclose a cavity having a substantially, rectangular cross-section and into which a steel tube fitting said cross-section is inserted.

17. A facade system according to claim 1, wherein the vertical section of the auxiliary frame is suspended from the main frame by a pin lying horizontally inside the facade plane, said pin being suspended in an undercut groove in one of the main frame and auxiliary frame.

18. A facade system according to claim 1, wherein the releasable connecting means comprise a U-shaped clamp which can be moved inside the facade plane, said clamp having U-legs extending parallel to the facade plane, which in the coupling position engagingly overlap with retaining legs on the auxiliary and main frames.

19. A facade system according to claim 18, wherein at least one retaining leg has an undercut behind which, in the coupling position, a lug disposed on a U-leg of the clamp engages.

20. A facade system according to claim 18, wherein said clamp has a base opening provided with a continuous internal thread oriented parallel to the U-legs and into which a freely rotatable coupling screw mounted in a frame leg is screwed.

21. A facade system according to claim 20, wherein said coupling screw has a drive member in each of its two ends for drivingly engaging a rotary driving tool.

22. A facade system according to claim 20, wherein said coupling screw is rotatably supported by a head on the side of said frame leg remote from said clamp and is secured by a Seeger ring on the opposite frame-leg side.

23. A facade system according to claim 20, wherein each coupling screw has an end aligned with said clearance space between the auxiliary and main frames.

24. A facade system according to claim 1, wherein adjacent frame legs of laterally or vertically adjacent auxiliary or main frames form between them an undercut groove for receiving a tensioning bolt which protrudes outward on the weather side between two plate-shaped elements and serves to attach cover strips which overlap said plate-shaped elements on the weather side.

25. A facade system according to claim 1, wherein at least two main frames are arranged one above the other with a joint between them, each main frame having an undercut groove into which a bar which bridges the horizontal joint is inserted.

26. A facade construction according to claim 8, wherein said seal has a section on the bonding side which allows a curvature in the groove.

* * * * *